United States Patent [19]

Vaguine

[11] 4,118,653

[45] Oct. 3, 1978

[54] VARIABLE ENERGY HIGHLY EFFICIENT LINEAR ACCELERATOR

[75] Inventor: Victor Aleksey Vaguine, Palo Alto, Calif.

[73] Assignee: Varian Associates, Inc., Palo Alto, Calif.

[21] Appl. No.: 752,936

[22] Filed: Dec. 22, 1976

[51] Int. Cl.[2] ..... H01J 25/10

[52] U.S. Cl. ..... 315/5.41; 315/3.6; 315/5.42

[58] Field of Search ..... 315/5.41, 5.42, 3.6, 315/39.53; 333/9

[56] References Cited

U.S. PATENT DOCUMENTS

| | | | |
|---|---|---|---|
| 2,813,996 | 11/1957 | Chodorow | 315/5.42 |
| 2,920,228 | 1/1960 | Ginzton | 315/5.41 X |
| 2,925,522 | 2/1960 | Kelliher | 315/5.42 |
| 3,546,524 | 12/1970 | Stark | 315/5.41 |
| 3,906,300 | 9/1975 | Tran | 315/5.41 |
| 4,024,426 | 5/1977 | Vaguine | 315/5.41 |

*Primary Examiner*—Saxfield Chatmon, Jr.
*Attorney, Agent, or Firm*—Leon F. Herbert; Stanley Z. Cole; Robert K. Stoddard

[57] ABSTRACT

An accelerator for a linear beam of charged particles has a first accelerating section upstream which modulates and accelerates the dc beam. This section is a traveling-wave circuit through which the entire rf power flows from the driving source. Output power from the other end of the traveling-wave section flows through a transmission line to a standing wave accelerating section downstream of the input section. An attenuator and a phase shifter between the two sections allow adjustment in the energy added to the particles in the downstream standing-wave section without disturbing the synchronism of the beam with the upstream accelerating section. As a result a high efficiency of acceleration and narrow energy spread of the final accelerated beam are achieved over a wide range of particle energies.

13 Claims, 4 Drawing Figures

VARIABLE ENERGY HIGHLY EFFICIENT LINEAR ACCELERATOR

FIELD OF THE INVENTION

The invention pertains to linear accelerators for charged particles such as used in medical radiation treatment, in high-energy radiography, in radiation processing of materials, and in physics research. In many applications of these accelerators, it is highly desirable to be able to adjust the final energy of the accelerated particles while maintaining a small energy spread of the particles and high efficiency of acceleration.

PRIOR ART

The commonly known way to vary the energy of the beam emerging from a linear accelerator driven by a source of high frequency electromagnetic wave energy was simply to vary the energy from the source, as by an attenuator in the connecting waveguide. This system has an inherent fault. At the very start of the accelerating microwave circuit, the stream of charged particles, for example, electrons, is focused in phase with respect to the electromagnetic wave and accelerated to a velocity approaching the velocity of light (at least for electrons). This initial region of the accelerator can be designed to produce optimum phase and velocity of the beam such that by later acceleration the energy spread of the resultant beam is very narrow and the efficiency of the accelerator is high. However, when the amplitude of the rf field is changed, as by changing the input power, the synchronising and phase focusing conditions are disturbed, producing a broadening of the output energy spectrum and a decrease in efficiency.

FIG. 1 shows the energy spectrum of a conventional accelerator having a single standing-wave accelerating section. The spread in particle output energy is quite narrow when the accelerator is operated at the intermediate energy (c) for which the design was optimized, but becomes undesirably broad at lower (a), (b) or higher (d), (e) energies.

A previous attempt to solve the problem of energy control was to divide the accelerator into two cascaded traveling-wave sections. U.S. Pat. No. 2,920,228 issued Jan. 5, 1960 to E. L. Ginzton and U.S. Pat. No. 3,070,726 issued Dec. 25, 1962 to K. B. Mallory describe such variable-energy accelerators. The input rf power went first through the input, upstream section. The rf wave was then attenuated to regulate the rf power in the second, downstream traveling-wave section, and hence the output electron energy. This scheme was not capable of producing high efficiency because the traveling-wave accelerator is less efficient than the commonly used side-coupled cavity standing-wave accelerator. The wave energy left after a single pass through the wave guiding structure is thrown away in a dissipative load.

SUMMARY OF THE INVENTION

An object of the invention is to provide a linear accelerator in which the uniformity of the energy of the accelerated particles remains optimized while the average energy is varied.

A further object is to provide a variable-energy accelerator having high efficiency.

These objects are achieved by sending the beam of charged particles first through a short accelerator section carrying a traveling rf wave and then through a second section excited by a standing wave. The input rf energy is fed through the traveling-wave section and then through an adjustable attenuator into the standing wave section. Thus at the beam input end where the phase focussing of the electron beam occurs, the rf fields are always at their maximum level for which the circuit is designed, thereby producing an optimum spectrum. Reducing the rf power in the output standing wave section does not harm the energy uniformity or the beam current because when the particles get to the output section they are bunched into a very short phase spread and are traveling at essentially the velocity of light so that varying the energy does not change their velocity appreciably. By using a backward-wave input section the standing-wave output section is fed power from the upstream end of the input section where the phase of the bunched beam is largely determined, so the phase synchronization of the output section may remain optimized with respect to the bunch independently of phase shifts in the input section.

DESCRIPTION OF THE PREFERRED EMBODIMENTS

In the following discussion, the invention will be described as accelerating electrons, but it is obvious that it can be used with proper design choices for other kinds of charged particles.

Figure 1:
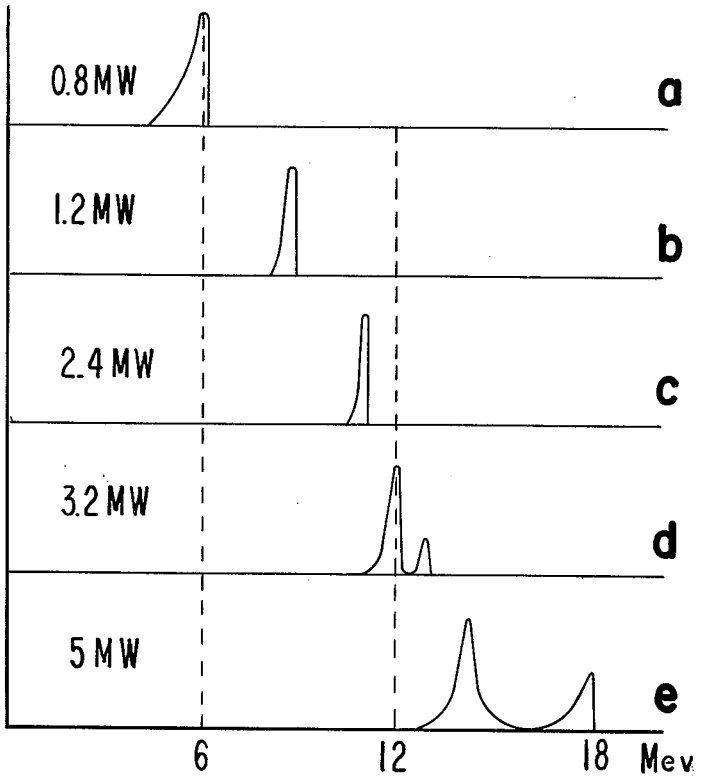
FIG. 1 is a plot of the energy spectrum of a prior-art accelerator.
Figure 2:
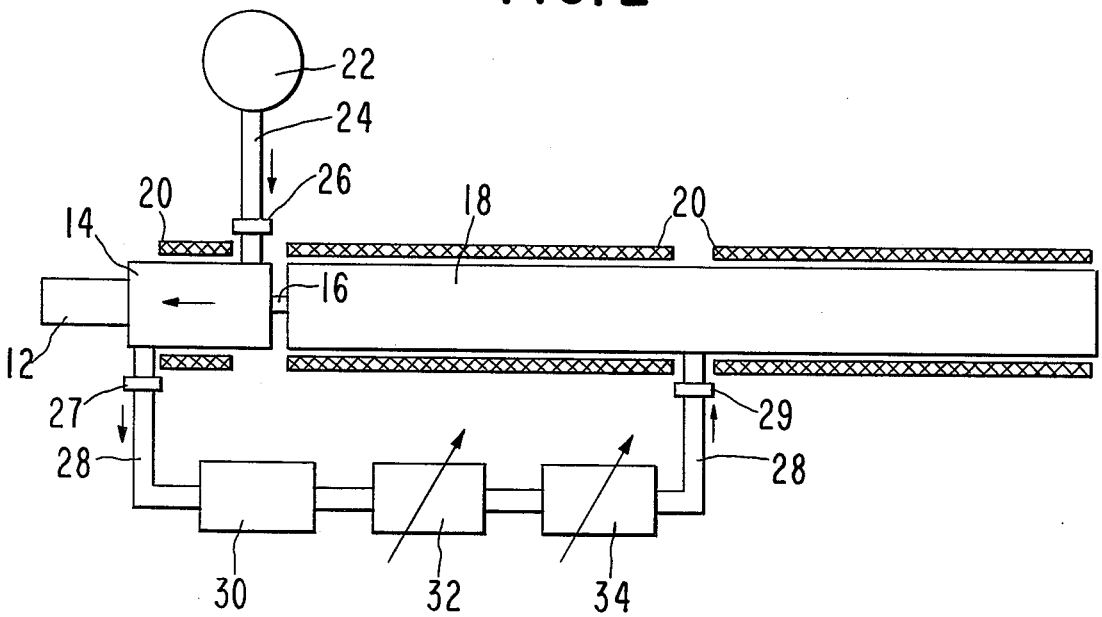
FIG. 2 is a schematic layout of an accelerator according to the present invention.

FIG. 2 shows the layout of the radio-frequency section of a linear accelerator according to my invention.

An electron gun 12 of conventional design projects a beam of electrons (not shown) into the first accelerating circuit 14. The beam is typically pulsed, with pulses a few microseconds long, but it may alternatively be a continuous beam. In circuit 14 the electrons are bunched, with one bunch per rf cycle, and accelerated to a velocity approaching the velocity of light by periodic interaction with the rf voltage.

The pre-accelerated beam leaves circuit 14 via a beam transfer tube 16 and enters the main accelerator section 18. Here the electrons are given much more energy by the rf field. Since they are traveling almost at the speed of light they are not accelerated much — the added energy goes into increased mass. The electrons throughout both circuits 14 and 18 are preferably held focussed in a linear beam of cylindrical outline by an axial magnetic field produced by solenoid magnets 20.

Microwave energy, typically at 2856 MHz in America, is produced by a generator 22, shown schematically. Generator 22 may be a klystron amplifier driven by a stable frequency source or by a synchronized signal fed back from circuit 18 which typically has a very high Q-factor. The output of generator 22 is fed through a waveguide 24 and a ceramic waveguide window 26 into one end of circuit 14, which is a periodically loaded circuit designed to propagate a traveling wave at the operating frequency with a phase velocity approximately equal to the velocity of the electrons being accelerated. The embodiment of FIG. 2 indicates the preferred backward-wave circuit 14. That is, for the phase of the fundamental space-harmonic component of the wave to propagate in the direction of electron motion (left to right) the energy flow is in the opposite direction. Therefore, the wave energy input 24 is at the downstream end of circuit 14. While there are advantages to a backward-wave circuit, to be described later, a forward-wave circuit may alternatively be used in which case the rf wave input would be at the upstream end. The phase velocity in circuit 14 may be tapered from a smaller value at the upstream end to a larger value at the downstream end to maintain synchronism with the particles being accelerated.

A smaller part of the rf wave energy is used up in flowing through traveling-wave circuit 14, in accelerating the electrons and in resistance loss in the circuit. The remaining greater part of the wave energy is coupled out through a second window 27 into a waveguide 28, whence coupled into the second accelerating section 18 through a third window 29. Inserted in series with waveguide 28 are an isolator 30, a variable attenuator 32 and a variable phase shifter 34. These are shown schematically because they can have any of a variety of forms and are standard commercial circuit elements. Also, known circuit elements may combine two or more the functions; for example, U.S. Pat. No. 3,868,602 issued Feb. 25, 1975 to Gard E. Meddaugh and assigned to the assignee of the present invention describes a combination isolator and variable attenuator. Also, combination variable attenuator-phase shifters and isolator-phase shifters are known.

Isolator 30 is desirable to protect other components from reflected waves due to impedance mismatches between the waveguides and the accelerating circuits. In particular, standing wave circuit 18 has a very high Q and therefore presents a severe returned wave during the transient times when the rf fields of short pulses are building up or decaying in it. Variable attenuator 32 allows a wide range of adjustment of the rf energy in circuit 18 and hence the output energy of the accelerated particles. Phase shifter 34 is used to optimize the phase of the standing wave in circuit 18 with respect to the phase of the incoming electron bunches so that they remain bunched and receive the desired acceleration. For maximum particle energy the peak accelerating field may be adjusted to follow the bunch. For reduced energy the particles may be phased to ride the rising part of the wave, whereby increased bunching and uniformity of energy is achieved.

Figure 3:
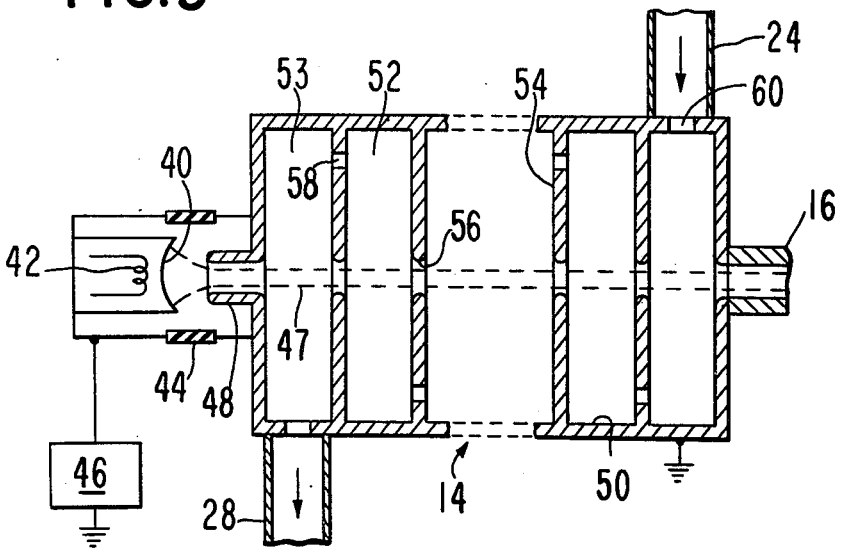
FIG. 3 is a sectional view of the traveling-wave section of the accelerator of FIG. 2.

FIG. 3 illustrates structural features of a suitable traveling-wave circuit 14 and gun 12. Gun 12 comprises a thermionic cathode 40, typically having a concave spherical emitting surface, heated by a radiant heater 42 and mounted via an insulating high-voltage seal 44 on the input end of circuit 14. Cathode 40 is periodically pulsed negative with respect to circuit 14, which is typically grounded, by a pulse generator 46. Electrons are then drawn from cathode 40 by a hollow reentrant anode 48 connected to circuit 14. They are converged into a small beam 47 by the converging electric field and projected into circuit 14.

Circuit 14 is a cylindrical metallic waveguide 50 divided into a series of pillbox cavities 52 by transverse metallic discs 54. Discs 54 have central orifices 56 aligned to pass electron beam 47. Each disc 54 has at least one other orifice 58 near its outer radius to couple wave energy from one cavity 52 to the next. Iris orifices 58 present a mutual inductance coupling cavities 52, so the propagated wave has a backward fundamental space harmonic. Wave energy is fed in from input waveguide 24 coupled by a matching iris 60 to circuit 14. Wave energy flows upstream of the electron beam and is coupled out into waveguide 28 after one passage through circuit 14. Cavity coupling irises 58 are dimensioned such that the fundamental pass-band of circuit 14 is broad enough to transmit any frequency variation of generator 22 required to resonate high-Q output circuit 18. It will be recognized that the interaction impedance of circuit 14 increases as the bandwidth decreases, so the bandwidth is chosen to fulfill the various requirements. The iris-coupled structure shown has the advantage that intercavity coupling is not required or desired through the beam orifices. These may thus be designed as small as possible to clear the beam, thus maximizing the coupling between the beam and the cavity fields and hence the efficiency of the traveling-wave section.

Figure 4:
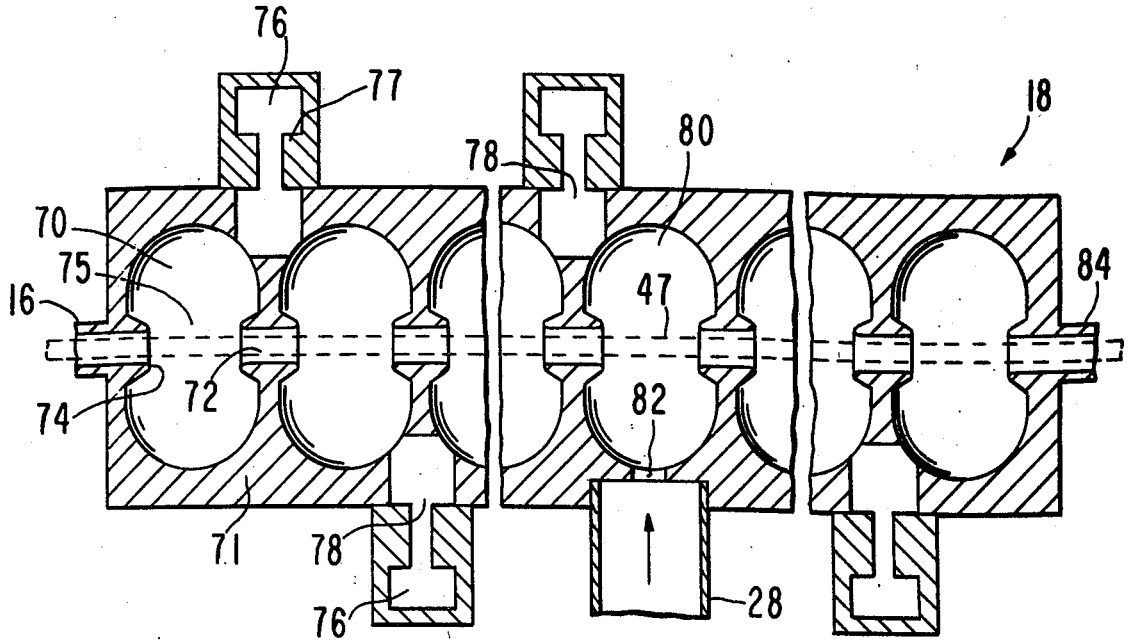
FIG. 4 is a sectional view of the standing-wave section of the accelerator of FIG. 2.

FIG. 4 illustrates structural features of a suitable standing-wave circuit 18. The circuit comprises a series of axially-aligned doughnut-shaped cavities 70. For simplicity, only six cavities are shown. In practice, a larger, preferably odd number are used. Through the walls 71 separating cavities 70 is an open tunnel 72 forming the passageway for electron beam 47. Adjacent tunnel 72, walls 71 have lips 74 projecting into cavities 70 to concentrate the electric field interacting with beam 47 in an interaction gap 75 and to reduce field leakage between cavities.

Adjacent pairs of cavities 70 are coupled together through "side" cavities 76, which are effectively coaxial cavities with re-entrant center posts 77. Side cavities 76 are resonant at the same frequency as the beam-interaction cavities 70. Each side cavity 76 is coupled to two adjacent interaction cavities 70 by inductive irises 78. Wave energy is fed from input waveguide 28 into one cavity 80 through an impedance matching iris 82. Cavity 80 is preferably at the center of an array of an odd number of cavities 70. This arrangement will minimize non-uniformity of fields along the array due to power extracted from the circuit by the beam and by circuit losses.

In operation, circuit 18 is driven at its $\pi/2$ mode resonance. That is, each side cavity 76 is $\pi/2$ radians out of phase with the interaction cavity 70 from which it is fed power and also with the adjacent interaction cavity 70 to which it feeds power. In this $\pi/2$ mode side cavities 76 contain only low electromagnetic fields so the losses in them are negligible. At the same time, cavities 70 which accelerate the beam each have the maximum field strength, and $\pi$ phase shift between adjacent cavities 70. The $\pi/2$ mode is also desirable because its resonant frequency separation from other modes is the greatest. Also, when an array of an odd number of accelerator cavities 70 is driven at the center cavity, excitation of the nearest resonant modes above and below the $\pi/2$ mode is suppressed because they have no field in the center cavity.

Beam 47 from traveling-wave circuit 14 enters circuit 18 through transfer tube 16. The phase of the fields is adjusted by phase shifter 34 so that the bunches of electrons cross the interaction gaps 75 at the times when the accelerating field has the desired value. The phase of the bunch with respect to the input wave power is largely determined by the first cavity 53 seen by the beam in traveling-wave section 14. Thus with the backward-wave circuit 14 shown in FIG. 3, any phase errors in the remainder of circuit 14 do not affect the phase optimization of standing-wave circuit 18 with respect to the electron bunch.

After full acceleration by circuit 18, the electron beam exits through aperture 84 to its utilization apparatus (not shown). This may be a target to produce X-rays or material to be directly irradiated by electrons passing out through a thin window.

The above described embodiment of the invention is intended to be illustrative and not limiting. Many other embodiments will be obvious to those skilled in the art; for example, many varieties of traveling-wave and standing-wave circuits may be used. The invention is intended to be limited only by the following claims and their legal equivalents.

I claim:

1. In a linear accelerator for charged particles:

a substantially linear first extended acceleration circuit comprising a passageway for transmitting a beam of charged particles through said circuit in energy exchanging relation with an electromagnetic wave on said circuit traveling generally parallel to said beam, a second acceleration circuit comprising a passage for transmitting said beam after emergence from said first circuit in energy exchanging relation with a standing electromagnetic wave on said second circuit, and first coupling means for coupling electromagnetic wave energy into one end of said first circuit and second coupling means for coupling electromagnetic energy out from the other end of said first circuit into said second circuit.

2. The apparatus of claim 1 wherein said second coupling means comprises adjustable wave energy attenuating means.

3. The apparatus of claim 1 wherein said second coupling means comprises adjustable phase shifting means.

4. The apparatus of claim 3 wherein said second coupling means further comprises adjustable attenuating means.

5. The apparatus of claim 1 wherein said first circuit is periodically loaded.

6. The apparatus of claim 5 wherein the fundamental space harmonic component of said traveling wave is a backward wave and said second coupling means couples energy out of the end of said first circuit at which said beam enters.

7. The apparatus of claim 5 wherein said first circuit is a series-coupled plurality of hollow cavities with conductive walls, adjacent cavities having a common wall, and said passageway comprises a beam transmissive aperture in said common wall.

8. The apparatus of claim 7 wherein said series-coupling is provided by at least one aperture in said common wall in addition to said beam-transmissive aperture.

9. The apparatus of claim 5 wherein said periodic loading is adapted to produce a phase shift of said electromagnetic wave per period of about $\pi/2$ radians.

10. The apparatus of claim 1 wherein said second circuit comprises a series-coupled plurality of hollow interaction cavities with conductive walls, adjacent cavities having a common wall, and said passageway comprising a beam-transmissive aperture in said common wall.

11. The apparatus of claim 10 wherein said series-coupling comprises an auxiliary cavity coupled to each of two adjacent interaction cavities.

12. The apparatus of claim 11 wherein the phase shift of said standing wave between adjacent interaction cavities is $\pi$ radians.

13. The apparatus of claim 12 wherein said second circuit comprises an odd number of said interaction cavities and said second coupling means is connected to couple electromagnetic energy into the center one of said interaction cavities.

* * * * *